US007131304B2

(12) United States Patent
Arai

(10) Patent No.: US 7,131,304 B2
(45) Date of Patent: Nov. 7, 2006

(54) SPINNING METHOD AND APPARATUS

(75) Inventor: Hirohiko Arai, Tsukuba (JP)

(73) Assignee: National Institute of Advanced Industrial Science and Technology, Tokyo (JP)

( * ) Notice: Subject to any disclaimer, the term of this patent is extended or adjusted under 35 U.S.C. 154(b) by 0 days.

(21) Appl. No.: 11/042,058

(22) Filed: Jan. 26, 2005

(65) Prior Publication Data

US 2005/0183484 A1 Aug. 25, 2005

(30) Foreign Application Priority Data

Jan. 30, 2004 (JP) ..... 2004-024253

(51) Int. Cl.
*B21D 5/00* (2006.01)

(52) U.S. Cl. ..... 72/82; 72/10.4; 72/430

(58) Field of Classification Search ..... 72/8.3, 72/9.5, 10.4, 11.1, 12.1, 82, 83, 84, 85, 430; 700/170, 186, 187, 193
See application file for complete search history.

(56) References Cited

U.S. PATENT DOCUMENTS 4,976,126 A * 12/1990 Yamamoto et al. ..... 72/83
5,220,817 A * 6/1993 Wenzel et al. ..... 72/84
5,355,705 A * 10/1994 Schulze et al. ..... 72/83
5,775,151 A * 7/1998 Massee ..... 72/10.4
5,901,595 A * 5/1999 Massee ..... 72/81
5,960,661 A * 10/1999 Massee ..... 72/81

FOREIGN PATENT DOCUMENTS

EP 125720 * 3/1987

* cited by examiner

*Primary Examiner*—Ed Tolan
(74) *Attorney, Agent, or Firm*—Oblon, Spivak, McClelland, Maier & Neustadt, P.C.

(57) ABSTRACT

A spinning method which makes it possible to control the pressing force of a roller tool with satisfactorily high responsiveness and have the roller tool press work following the contour of a forming die even if the die may have its radial length vary at a high speed relative to the angle of its rotation when making a product which is not circular in its cross section normal to the axis of rotation of the die, and an apparatus therefor. The roller tool is driven by at least two mutually crossing linear motors and the thrust to be generated by each linear motor is adjusted to control the feeding displacement of the roller tool and the pressing force of the roller tool against a piece of work.

14 Claims, 4 Drawing Sheets

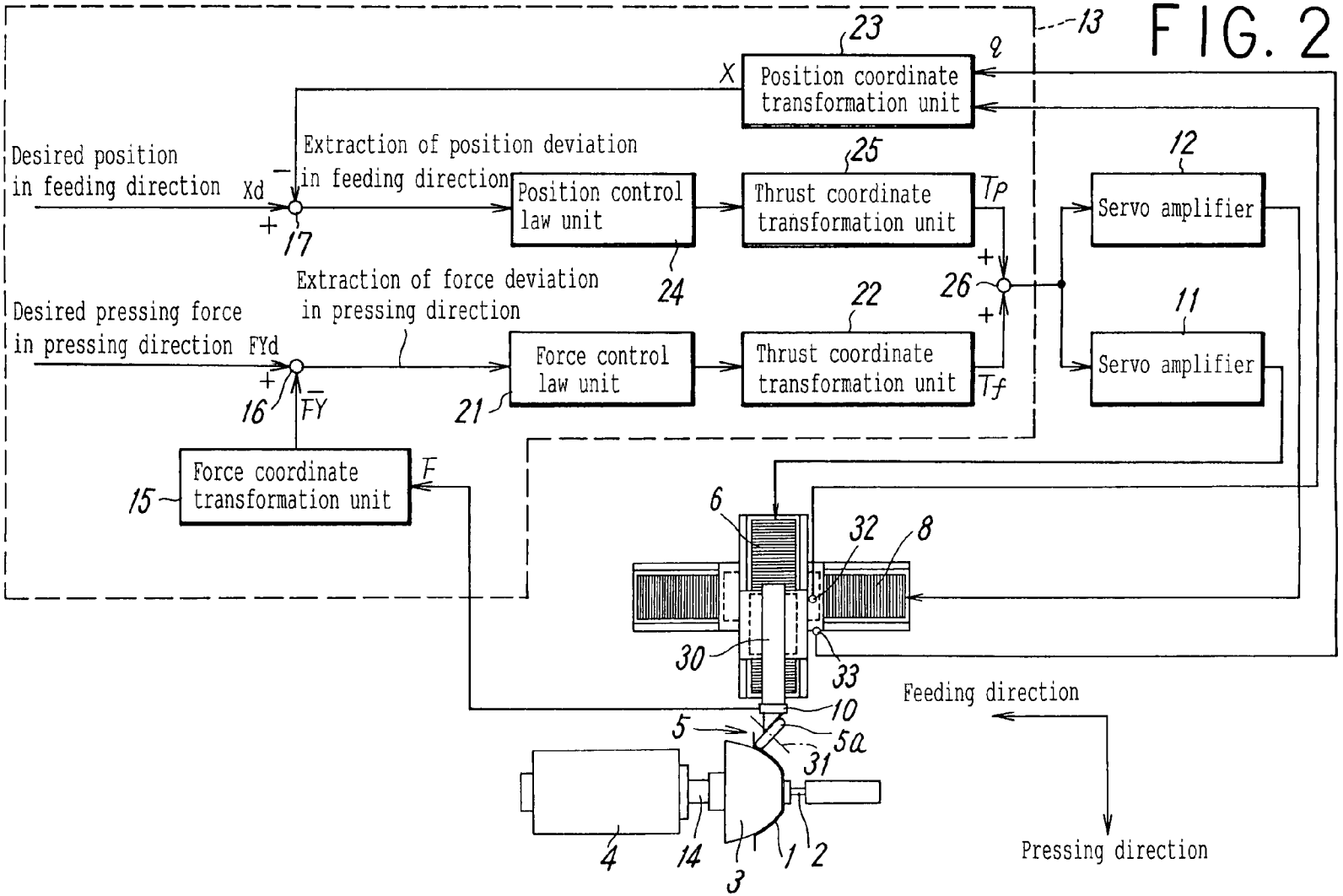
FIG. 2
Servo amplifier
Servo amplifier
Position coordinate transformation unit
Thrust coordinate transformation unit
Thrust coordinate transformation unit
Position control law unit
Force control law unit
Force coordinate transformation unit
Extraction of position deviation in feeding direction
Extraction of force deviation in pressing direction
Desired position in feeding direction Xd
Desired pressing force in pressing direction FYd
Feeding direction
Pressing direction

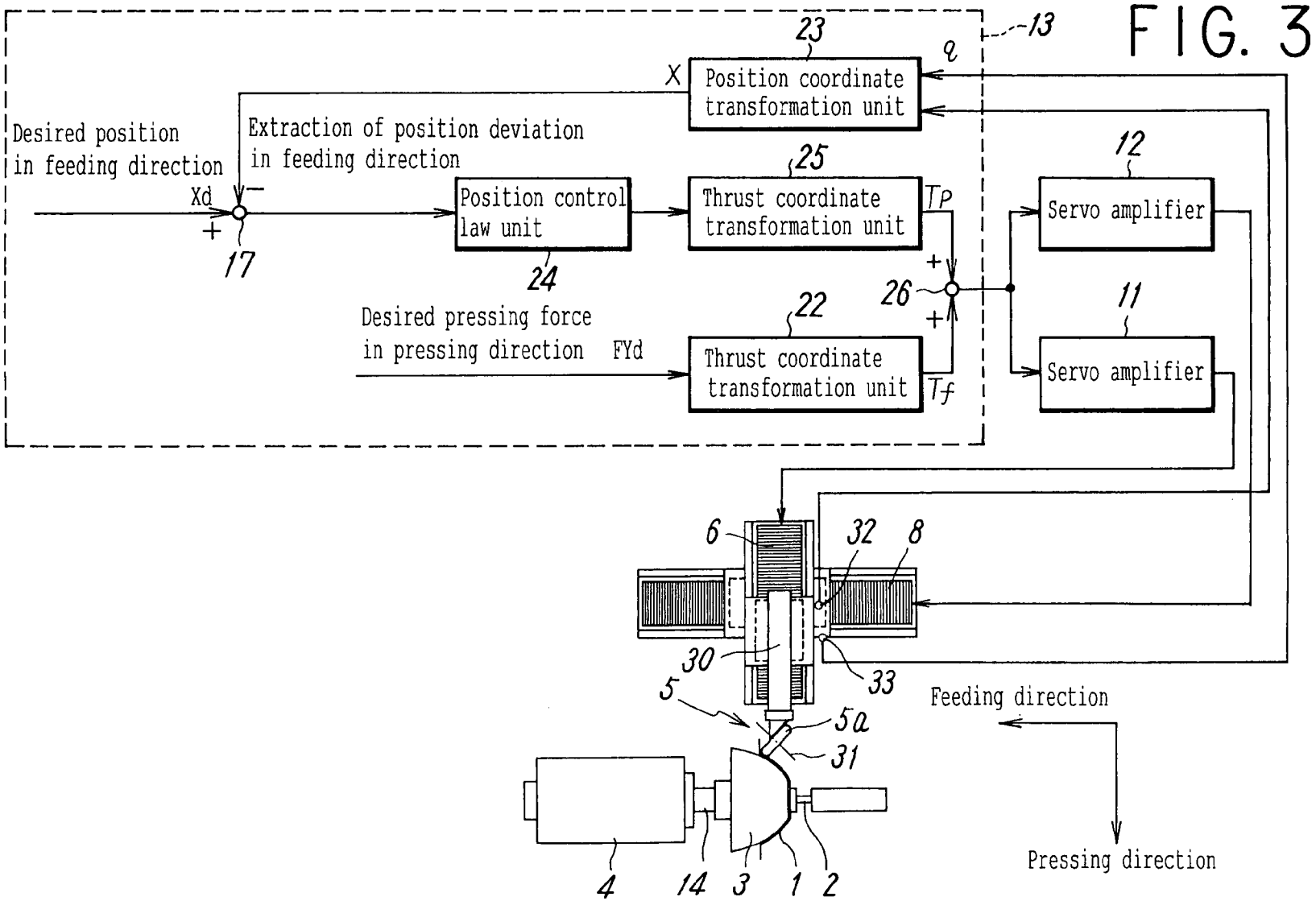
FIG. 3
13
12
Servo amplifier
11
Servo amplifier
Feeding direction
Pressing direction
q
23
Position coordinate transformation unit
X
25
Thrust coordinate transformation unit
Tp
26
+
+
22
Thrust coordinate transformation unit
Tf
8
32
33
5a
31
2
1
3
14
4
6
30
5
Extraction of position deviation in feeding direction
24
Position control law unit
Desired pressing force in pressing direction
FYd
17
−
+
Xd
Desired position in feeding direction

SPINNING METHOD AND APPARATUS

FIELD OF THE INVENTION

This invention relates to a spinning method and an apparatus therefor.

BACKGROUND OF THE INVENTION

Spinning is a method of forming a sheet or tube of work into a particular shape by centering it on a forming die and pressing it against the die by a roller tool, while rotating it with the die, and has been widely used in manufacturing various kinds of parts and products from metal sheets. A spinning apparatus is an apparatus for forming a sheet or tube of work into a particular shape by centering it on a forming die and pressing it against the die by a roller tool, while rotating it with the die.

A spinning apparatus is usually composed of a spindle for rotating a forming die and a piece of work and a plurality of (usually two) mutually crossing direct-acting actuators for driving a roller tool to press the work against the die.

Hydraulic cylinders or ball screw mechanisms rotated by servo motors have hitherto been used as the direct-acting actuators for driving the roller tool in a spinning apparatus. The law of control employed for the direct-acting actuators has been of position or speed control.

The clearance between the forming die and the roller tool is a factor which is particularly difficult to select in view of the control of a spinning apparatus, as compared with the other spinning conditions. The clearance has to be controlled accurately in accordance with the wall thickness of the product to be manufactured, and seriously affects its quality. The allowable range for a proper clearance is very narrow particularly when a sheet having a small thickness has to be worked upon. It is, therefore, necessary to position the roller accurately relative to the forming die. It is also necessary to have accurate information on the cross-sectional shape of the forming die. Moreover, it is necessary to follow the desired route of the roller accurately when a working force is acting.

It is, however, difficult to predict the wall thickness distribution of any product accurately when the product has a complicated shape, or is made by a multi-cycle draw spinning method in which its material is deformed progressively. For these reasons, the experience of people working at the site of manufacture is considerably relied upon for the selection of the clearance and forming tests are often conducted for the adjustment of the clearance.

In order to overcome those problems and eliminate the necessity for the accurate positioning of a forming die and a roller tool relative to each other and realize a proper clearance between the die and the roller tool, even if no accurate information may be available on the wall thickness of the product as intended, I, the inventor of this invention, have already invented a spinning method characterized by controlling a force with which a roller tool is pressed against work (see Japanese Patent Office Official Gazette JP-A-2004-223558). The invention disclosed therein will hereinafter be called the "earlier-filed invention".

As spinning is performed by rotating a forming die and work, a roller tool is usually held substantially in a fixed position radially of the die, while it is displaced over a certain distance when it is fed along the axis of rotation of the die. Therefore, it has hitherto been possible to make only axially symmetric products having a circular cross section having its center on the axis of rotation of a forming die when it is taken at right angles to that axis. If it is possible to make also products having other shapes, such as polygonal or oval, in their cross sections normal to the axis of rotation of the die, it will be possible to realize the versatility of the products which can be manufactured, and thereby expand the applicability of spinning.

As a solution, there has been proposed a method in which a roller tool is pressed against work with a fixed force by a hydraulic cylinder to follow the contour of a forming die to make a product having a cross section other than circular (see JP-B-4-22648). The invention disclosed therein will hereinafter be called the "publicly known invention".

The earlier-filed and publicly known inventions share the feature of controlling the pressing force of the roller tool. However, in the known spinning apparatus in which hydraulic cylinders or ball screw mechanisms are used to drive the roller tool, it is difficult to constitute a force control of satisfactorily high responsiveness because of the sliding friction between the cylinders and pistons, fluid resistance in a piping system for a hydraulic fluid, responsiveness of servo valves, friction and backlash of ball screws, elasticity of the joints between motors and ball screws, etc.

In the case of making any product that is not circular in its cross section normal to the axis of rotation of a forming die, it can be made only at a lower speed, since it is necessary to lower than usual the rotating speed of the die and work to allow hydraulic cylinders or ball screws to expand or contract quickly in response to any variation in radial length of the die.

SUMMARY OF THE INVENTION

It is an object of this invention to solve the problems as pointed out above and provide a spinning method which makes it possible to control the pressing force of a roller tool with satisfactorily high responsiveness and have the roller tool press work following the contour of a forming die even if the die may have its radial length vary at a high speed relative to the angle of its rotation when making a product which is not circular in its cross section normal to the axis of rotation of the die, and an apparatus therefor.

In order to attain the above object, there is provided a spinning method of forming a sheet of work into a particular shape by pressing it against a rotating forming die by a roller tool, characterized in that the roller tool is driven by at least two mutually crossing linear motors, and that the thrust generated by each of the linear motors is adjusted to control the feeding displacement of the roller tool and the pressing force of the roller tool against the work to thereby enable the roller tool to follow any variation in the contour of the die with high responsiveness.

According to a preferred mode of carrying out the spinning method as defined above, the feeding displacement of the roller tool may be controlled by calculating the thrust to be generated by each linear motor for its position control in the feeding direction based on a deviation of the desired position of the roller tool from its actual position as determined from a signal from a displacement sensor detecting the displacement of the moving member of the linear motor and driving the linear motor so that it may generate a prescribed value of thrust as calculated, or the pressing force of the roller tool may be controlled by detecting a working force acting upon the roller tool by a force sensor installed thereon, calculating the component of the working force in its pressing direction from the working force as detected, calculating the thrust to be generated by each linear motor for its force control in the pressing direction based on a deviation of the component as calculated from the desired pressing force of the roller tool in its pressing direction as preset and driving the linear motor so that it may generate a prescribed value of thrust as calculated.

According to another preferred mode of carrying out the spinning method, the pressing force of the roller tool may be controlled by calculating the thrust to be generated by each linear motor for its force control in its pressing direction based on the preset desired pressing force of the roller tool in its pressing direction and driving the linear motor so that it may generate a prescribed value of thrust as calculated.

In order to attain the above object, there is also provided a spinning apparatus for forming a sheet of work into a particular shape by pressing it against a rotating forming die by a roller tool, characterized by comprising at least two mutually crossing linear motors for driving the roller tool and a control system for controlling the linear motors, the control system being adapted to adjust the thrust generated by the linear motors and thereby control the feeding displacement of the roller tool and the pressing force of the roller tool against the work.

According to a preferred form of the spinning apparatus as defined above, the control system may have a position coordinate transformation unit adapted to receive a signal from a displacement sensor installed on the moving members of the linear motors, a deviation unit adapted to receive an output signal from the position coordinate transformation unit and a signal indicating the desired position of the roller tool and output a deviation therebetween, a position control law unit adapted to receive an output signal from the deviation unit and output a signal indicating the thrust to be generated by the linear motor in the feeding direction and a thrust coordinate transformation unit adapted to receive an output signal from the position control law unit and output a signal indicating the thrust to be generated by each linear motor.

According to another preferred form of the spinning apparatus, the control system may have a force coordinate transformation unit adapted to receive a signal from a force sensor installed on the roller tool and output a signal indicating a component of force as measured in the pressing direction of the roller tool, a deviation unit adapted to receive a signal indicating the desired pressing force as preset of the roller tool in the pressing direction and the signal indicating the component of force and output a deviation therebetween, a force control law unit adapted to receive an output signal from the deviation unit and output a signal indicating the thrust to be generated by the linear motor in the pressing direction and a thrust coordinate transformation unit adapted to receive an output signal from the force control law unit and output a signal indicating the thrust to be generated by each linear motor.

According to still another preferred form of the spinning apparatus, the control system may have a thrust coordinate transformation unit adapted to receive a signal indicating the desired pressing force as preset of the roller tool in the pressing direction and output a signal indicating the thrust to be generated by each linear motor.

This invention makes it possible to control the pressing force of the roller tool with a satisfactorily high level of responsiveness, since the roller tool is driven by linear motors and the feeding displacement of the roller tool and its pressing force against work are controlled by adjusting the thrust generated by each linear motor, as stated above.

Therefore, it is possible to manufacture quickly even any product of high quality that is not circular in its cross section normal to the axis of rotation of the forming die, since it is possible to press work against the die with an adequate force by the roller tool without lowering the rotating speed of the die extremely, since the roller tool can press the work against the die by following its contour even if the radial length of the die may vary at a high speed relative to its angle of rotation.

BRIEF DESCRIPTION OF THE DRAWINGS

FIG. 2 is a diagram outlining the arrangement of a control system in the apparatus;

FIG. 3 is a diagram outlining the arrangement of a different control system in the apparatus;

BEST MODE OF CARRYING OUT THE INVENTION

Figure 1:
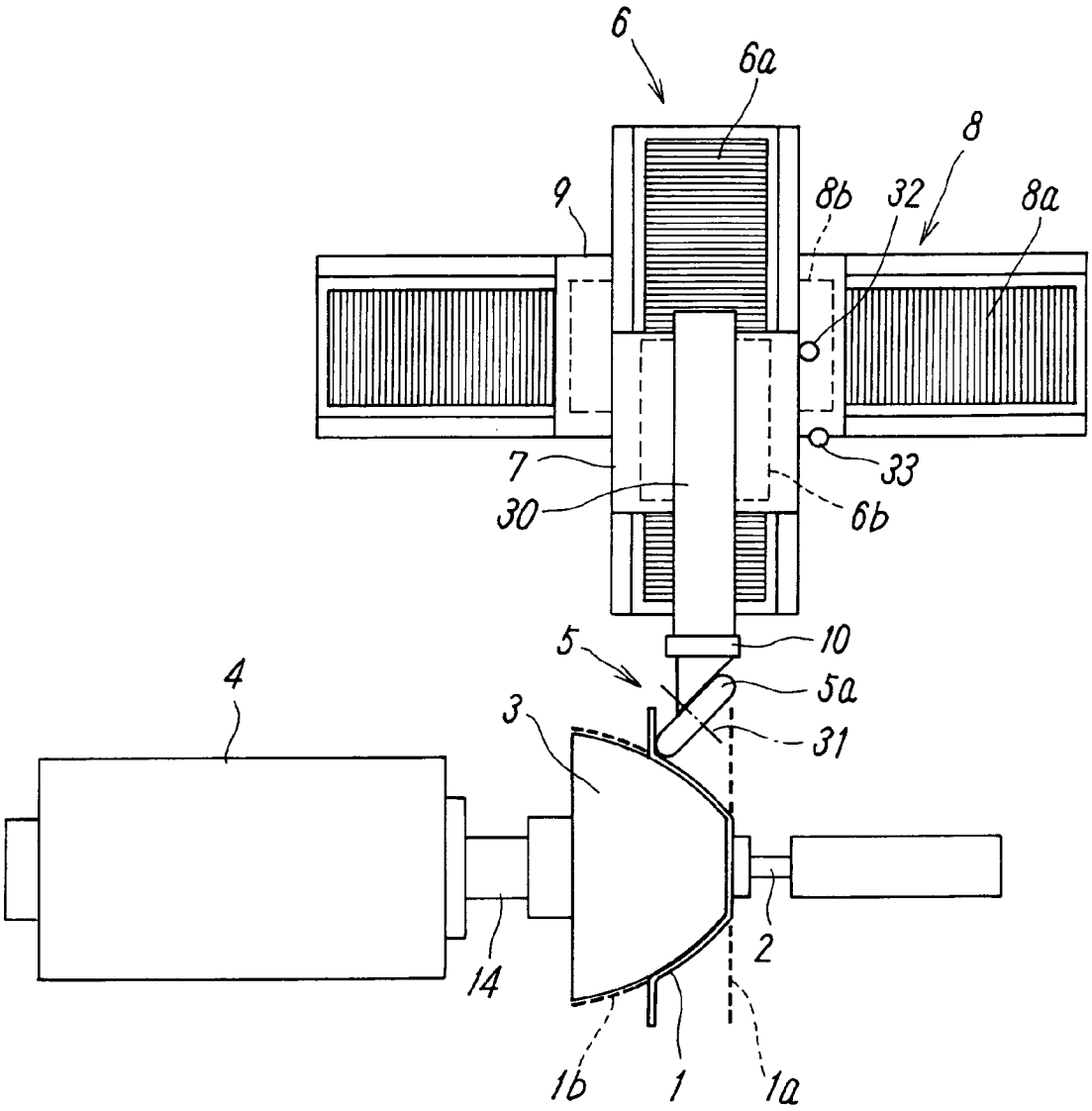
FIG. 1 is a diagram outlining a spinning apparatus embodying this invention.

FIG. 1 is a diagram outlining a spinning apparatus embodying this invention. Work 1 is centered on a forming die 3 by a centering push rod 2 and is rotatable with the die 3 by a spindle motor 4. A roller tool 5 is movable back or forth radially of the die 3 (i.e., in either direction normal to a rotating shaft 14 for the die 3) by a back and forth translatory table 7 driven by a back and forth linear motor 6 composed of a stationary member 6*a* and a moving member 6*b*. The translatory table 7 is movable back or forth along the rotating shaft for the die 3 by a transverse translatory table 9 driven by a transverse linear motor 8 composed of a stationary member 8*a* and a moving member 8*b*.

The transverse linear motor 8 is so positioned that its axis (i.e., the direction of movement of its moving member 8*b*) may be parallel to the rotating shaft 14 for the die 3, and the transverse translatory table 9 is fixed to the moving member 8*b*, while the stationary member 6*a* of the linear motor 6 is fixed to the transverse translatory table 9 at right angles to the axis of the transverse linear motor 8. Accordingly, the roller tool 5 is movable by the translatory table 7 in parallel to the rotating shaft 14 and at right angles thereto.

The stationary members 6*a* and 8*a* of the linear motors 6 and 8, respectively, are permanent magnets (field) and their moving members 6*b* and 8*b* are coils, so that an electric current is supplied to the moving members 6*b* and 8*b* to generate thrust. These arrangements are, however, not limitative, but the stationary members 6*a* and 8*a* of the linear motors 6 and 8 may alternatively be coils, while their moving members 6*b* and 8*b* are permanent magnets, or the motors may alternatively be linear induction or DC motors.

Displacement sensors 32 and 33 for detecting the magnitudes of linear displacement of the moving members 6*b* and 8*b*, respectively, such as encoders, are attached to the translatory tables 7 and 9 fixed to the moving members 6*b* and 8*b*, respectively.

The roller tool 5 is attached to the end of a supporting shaft 30 fixed to the back and forth translatory table 7 and has a roller 5*a* which is rotatable about an axis 31. The roller tool 5 has a force sensor 10 adapted to detect a working force applied to the work 1. The force sensor 10 is a six-axis force sensor which can detect three components of force along three axes (X, Y and Z), respectively, and three components of moment about the three axes simultaneously, and such a six-axis force sensor is commercially available. The work 1 is pressed against the die 3 by the roller tool 5 and is thereby formed from a flat sheet 1*a* as its initial shape into its final shape 1*b* complementary to the contour of the die 3.

FIG. 2 is a diagram outlining the arrangement of a control system in the spinning apparatus according to this invention. The working force F acting on the roller tool 5 is detected by the force sensor 10 and a signal representing the working force F is inputted to a control system 13, while the control system 13 is also adapted to receive displacement sensor signals q representing the magnitudes of displacement of the moving members 6*b* and 8*b* as detected by the displacement sensors 32 and 33, calculate the thrust to be generated by the linear motors 6 and 8 and thereby control the linear motors 6 and 8. The control system 13 may be either a specially prepared apparatus or a computer.

Description will now be made of various units constituting the control system 13 and their functions.

Referring to FIG. 2, the working force F acting on the roller tool 5 is detected by the force sensor 10 and a signal representing the working force F is inputted to a force coordinate transformation unit 15 in the control system 13, whereby a component FY of the working force F acting in the pressing direction against the sidewall of the die 3 is determined.

A deviation of the component FY in the pressing direction as actually determined from the desired pressing force FYd as preset of the roller tool 5 in the pressing direction is extracted by a deviation unit 16 and the thrust Tf to be generated by each linear motor 6 or 8 for force control in the pressing direction is calculated in accordance with a force control law unit 21 and a thrust coordinate transformation unit 22.

The displacement sensor signals q are inputted to a position coordinate transformation unit 23 in the control system 13, in which the actual position X of the roller tool 5 in the feeding direction is determined by position coordinate transformation. A deviation of the actual position X of the roller tool 5 as determined from its desired position Xd varying with a specified feeding rate is extracted by a deviation unit 17 and the thrust Tp to be generated by each linear motor 6 or 8 for position control in the feeding direction is calculated in accordance with a position control law unit 24 and a thrust coordinate transformation unit 25.

The thrust Tf to be generated by each linear motor 6 or 8 for force control in the pressing direction and the thrust Tp for position control in the feeding direction are added to each other by an adding unit 26 and an output signal from the adding unit 26 is given to servo amplifiers 11 and 12 as a prescribed value of thrust. The servo amplifiers 11 and 12 output a winding current conforming to the prescribed value of thrust to the linear motors 6 and 8, respectively.

The force control law unit 21 is a device for obtaining a thrust for driving the roller tool 5 in its pressing direction in the absolute coordinates from a deviation of the actual component FY in the pressing direction of the roller tool 5 as determined (i.e., the feedback signal from the force sensor 10) from its desired pressing force FYd in its pressing direction to realize its desired pressing force FYd.

The position control law unit 24 is a device for obtaining a thrust for driving the roller tool 5 in its feeding direction in the absolute coordinates from a deviation of its actual position X as determined (i.e., the feedback signals from the displacement sensors 32 and 33) from its desired position Xd to realize its desired position Xd.

When the pressing and feeding directions of the roller tool 5 coincide with the directions of the axes of the linear motors 6 and 8, respectively, as shown in FIG. 2, the thrusts for driving the roller tool 5 in its pressing and feeding directions are equal to those of the linear motors 6 and 8, but as it is also possible that the linear motors 6 and 8 may be inclined to the pressing and feeding directions of the roller tool 5, it is the thrust coordinate transformation units 22 and 25 that calculate and output the thrusts of the linear motors 6 and 8 as required for realizing the thrust for driving the roller tool 5. The thrust coordinate transformation units 22 and 25, therefore, cover both the case in which the pressing and feeding directions of the roller tool 5 coincide with the directions of the axes of the linear motors 6 and 8, respectively, and the case in which they do not.

Thus, the roller tool 5 makes it possible to perform a spinning job by pressing the work 1 against the die 3 with the desired pressing force FYd, while moving in its feeding direction to its desired position Xd as prescribed.

The feeding and pressing directions of the roller tool 5 may extend along the axis of rotation of the die 3 and along its radius, respectively, as shown in FIG. 2, or may alternatively be tangential and normal, respectively, to the sidewall of the die. Those directions can be selected as desired by the calculations of coordinate transformation (force, position or thrust coordinate transformation).

The linear motors have only a very small loss of thrust caused by frictional resistance and as they do not have any speed reducing mechanism, their effective inertia is low as viewed from the object to be thereby driven. It is, therefore, possible to omit the force sensor from the roller tool and constitute an open loop of force control.

In that case, the desired pressing force FYd of the roller tool 5 is directed converted by coordinates to the thrust Tf to be generated by the linear motors 6 and 8 for force control in the pressing direction, as shown in FIG. 3. The use of this control law makes it possible to constitute a spinning apparatus which is substantially equally effective without the aid of any force sensor.

The linear motors can generate the thrust corresponding to the winding current applied thereto and impart it to the object to be thereby driven, directly without the aid of any transmission mechanisms, such as ball screws. They have only a very small loss of thrust caused by friction as compared with hydraulic cylinders or ball screw mechanisms, since they do not have any sliding part, but it is only the linear bearings in their linear guide mechanisms that produce frictional resistance.

Moreover, the linear motors are operable at a higher speed than the hydraulic cylinders or ball screw mechanisms are, since even products which are operable at a maximum speed of 5 m/sec. and a maximum acceleration of 30 G are commercially available. Therefore, the use of linear motors as direct acting actuators for driving the roller tool in a spinning apparatus makes it possible to realize the highly responsive control of the pressing force by the roller tool.

Figure 4:
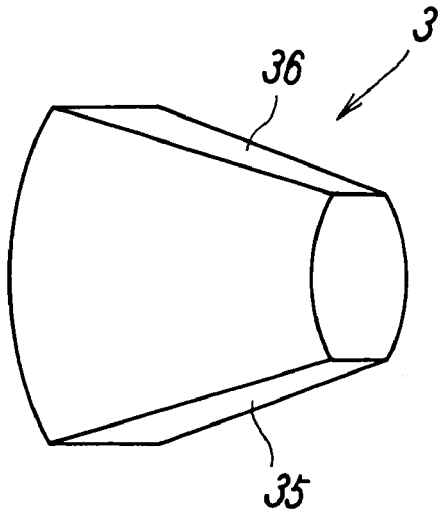
FIG. 4 is a perspective view showing an example of a forming die used to manufacture a product which is not circular in its cross section normal to the axis of rotation of the die.
Figure 5:
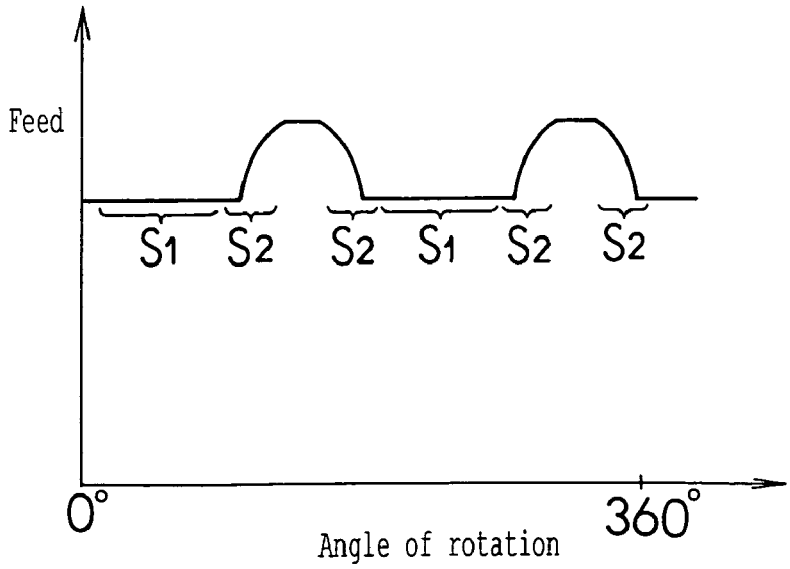
FIG. 5 is a graph outlining the feed of a roller tool in relation to the angle of rotation of the die shown in FIG. 4.

FIG. 4 is a perspective view of a forming die 3 used to manufacture a product which is not circular in its cross section normal to the rotating shaft for the die, and FIG. 5 is a graph outlining the feed of the roller tool in relation to the angle of rotation of the die 3 shown in FIG. 4. Referring to the cross section of the die 3 at right angles to the rotating shaft 14 therefor, its arcuate portions 35 hardly make any change in the feed of the roller tool radially of the die as shown by sections S1 in FIG. 5, but its straight portions 36 make a great change therein as shown by sections S2 in FIG. 5.

Although the known spinning apparatus makes it necessary to lower than usual the rotating speed of the die and work to allow the hydraulic cylinders or ball screws to expand or contract quickly in response to any variation in radial length of the die and has, therefore, a low working speed, the spinning method and apparatus according to this invention make it possible to press the work along the contour of the die without lowering the rotating speed of the die and work even in areas making a great change in the feed of the roller tool radially of the die as shown by the sections S2 in FIG. 5, since the roller tool is driven by the linear motors and the feeding displacement of the roller tool and its pressing force against the work are controlled by adjusting the thrust generated by each linear motor.

Therefore, the spinning method and apparatus according to this invention make it possible to manufacture quickly even any product of high quality that is not circular in its cross section normal to the axis of rotation of the forming die, since it is possible to press the work against the die with an adequate force by the roller tool without lowering the rotating speed of the die extremely.

While the best mode of carrying out this invention has been described by way of the spinning method and apparatus embodying it, it is needless to say that this invention is not limited to those embodiments, but that variations or modifications may be made without departing from the technical scope of this invention which is defined by the appended claims.

INDUSTRIAL APPLICABILITY

The spinning method and apparatus according to this invention as described above are widely applicable as a method of manufacturing products from metals in the manufacture of parts and products including household containers, ornaments, lighting fixtures, communications (parabolic antennas, etc.), boilers, tanks, nozzles, engine parts and tire wheels.

What is claimed is:

1. A spinning method of forming a sheet of work into a particular shape by pressing it against a rotating forming die by a roller tool, comprising:

driving the roller tool by at least two mutually crossing linear motors; and adjusting thrust generated by each of the linear motors to control feeding displacement of the roller tool and a pressing force of the roller tool against the work to thereby enable the roller tool to follow any variation in contour of the die with high responsiveness.

2. A spinning method as set forth in claim 1, wherein the feeding displacement of the roller tool is controlled by calculating the thrust to be generated by each linear motor for its position control in a feeding direction based on a deviation from a desired position of the roller tool of its actual position as determined from a signal from a displacement sensor detecting a displacement of the moving member of the linear motor and driving the linear motor so that it may generate a prescribed value of thrust as calculated.

3. A spinning method as set forth in claim 1, wherein the pressing force of the roller tool is controlled by detecting a working force acting upon the roller tool by a force sensor installed thereon, calculating a component of the working force in its pressing direction from the working force as detected, calculating the thrust to be generated by each linear motor for its force control in the pressing direction based on a deviation of the component as calculated from a desired pressing force of the roller tool in its pressing direction as preset and driving the linear motor so that it may generate a prescribed value of thrust as calculated.

4. A spinning method as set forth in claim 1, wherein the pressing force of the roller tool is controlled by calculating the thrust to be generated by each linear motor for its force control in its pressing direction based on a preset desired pressing force of the roller tool in its pressing direction and driving the linear motor so that it may generate a prescribed value of thrust as calculated.

5. A spinning method as set forth in claim 2, wherein the pressing force of the roller tool is controlled by detecting a working force acting upon the roller tool by a force sensor installed thereon, calculating a component of the working force in its pressing direction from the working force as detected, calculating the thrust to be generated by each linear motor for its force control in the pressing direction based on a deviation of the component as calculated from a desired pressing force of the roller tool in its pressing direction as preset and driving the linear motor so that it may generate a prescribed value of thrust as calculated.

6. A spinning method as set forth in claim 2, wherein the pressing force of the roller tool is controlled by calculating the thrust to be generated by each linear motor for its force control in its pressing direction based on a preset desired pressing force of the roller tool in its pressing direction and driving the linear motor so that it may generate a prescribed value of thrust as calculated.

7. The spinning method a set forth in claim 1, wherein a moving member of the linear motor moves along a linear path relative to a stationary part of the linear motor.

8. A spinning apparatus for forming a sheet of work into a particular shape by pressing it against a rotating forming die by a roller tool, comprising:

at least two mutually crossing linear motors for driving the roller tool; and a control system for controlling the linear motors, the control system being adapted to adjust thrust generated by each linear motor and thereby control the feeding displacement of the roller tool and the pressing force of the roller tool against the work.

9. A spinning apparatus as set forth in claim 8, wherein the control system comprises a position coordinate transformation unit adapted to receive a signal from a displacement sensor installed on a moving member of each linear motor, a deviation unit adapted to receive an output signal from the position coordinate transformation unit and a signal indicating a desired position of the roller tool and output a deviation therebetween, a position control law unit adapted to receive an output signal from the deviation unit and output a signal indicating thrust to be generated by the linear motor in a feeding direction and a thrust coordinate transformation unit adapted to receive an output signal from the position control law unit and output a signal indicating the thrust to be generated by each linear motor.

10. A spinning apparatus as set forth in claim 8, wherein the control system comprises a force coordinate transformation unit adapted to receive a signal from a force sensor installed on the roller tool and output a signal indicating a component of force as measured in a pressing direction of the roller tool, a deviation unit adapted to receive a signal indicating a desired pressing force as preset of the roller tool in its pressing direction and the signal indicating the component of force and output a deviation therebetween, a force control law unit adapted to receive an output signal from the deviation unit and output a signal indicating the thrust to be generated by the linear motor in the pressing direction and a thrust coordinate transformation unit adapted to receive an output signal from the force control law unit and output a signal indicating the thrust to be generated by each linear motor.

11. A spinning apparatus as set forth in claim 8, wherein the control system includes a thrust coordinate transformation unit adapted to receive a signal indicating the desired pressing force as preset of the roller tool in its pressing direction and output a signal indicating the thrust to be generated by each linear motor.

12. A spinning apparatus as set forth in claim 8, wherein the control system comprises a force coordinate transformation unit adapted to receive a signal from a force sensor installed on the roller tool and output a signal indicating a component of force as measured in a pressing direction of the roller tool, a deviation unit adapted to receive a signal indicating a desired pressing force as preset of the roller tool in its pressing direction and the signal indicating the component of force and output a deviation therebetween, a force control law unit adapted to receive an output signal from the deviation unit and output a signal indicating the thrust to be generated by the linear motor in the pressing direction and a thrust coordinate transformation unit adapted to receive an output signal from the force control law unit and output a signal indicating the thrust to be generated by each linear motor.

13. A spinning apparatus as set forth in claim 9, wherein the control system includes a thrust coordinate transformation unit adapted to receive a signal indicating the desired pressing force as preset of the roller tool in its pressing direction and output a signal indicating the thrust to be generated by each linear motor.

14. The spinning method a set forth in claim 8, wherein a moving member of the linear motor moves along a linear path relative to a stationary part of the linear motor.

* * * * *